US006591568B1

(12) United States Patent
Pålsson

(10) Patent No.: US 6,591,568 B1
(45) Date of Patent: Jul. 15, 2003

(54) FLOORING MATERIAL

(75) Inventor: Jörgen Pålsson, Landskrona (SE)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 09/672,076

(22) Filed: Sep. 29, 2000

(30) Foreign Application Priority Data

Mar. 31, 2000 (SE) ..... 0001149

(51) Int. Cl.[7] ..... E04B 2/32; E04B 2/46

(52) U.S. Cl. ..... 52/592.2; 52/50; 52/582.1; 52/586.1; 52/588.1

(58) Field of Search ..... 52/589.1 B, 592.1, 52/592.4, 588.1, 480, 590.2, 592.3, 586.1, 403.1, 586.05, 582.1, 50

(56) References Cited

U.S. PATENT DOCUMENTS

| | | | |
|---|---|---|---|
| 2,004,193 | A | 6/1935 | Cherry |
| 2,740,167 | A | 4/1956 | Rowley |
| 3,479,784 | A | 11/1969 | Massagli |
| 3,553,919 | A | 1/1971 | Omholt |
| 3,720,027 | A | 3/1973 | Christensen |

(List continued on next page.)

FOREIGN PATENT DOCUMENTS

| | | | |
|---|---|---|---|
| BE | 1010487 | | 12/1999 |
| CA | 991373 | * | 6/1976 |
| DE | 2159042 | | 6/1973 |
| DE | 22386660 | | 2/1974 |
| DE | 3343601 | | 6/1985 |

(List continued on next page.)

OTHER PUBLICATIONS

U.S. patent application Ser. No. 09/672,077, pending.
U.S. patent application Ser. No. 09/988,014, pending.
U.S. patent application Ser. No. 09/770,395, pending.
U.S. patent application Ser. No. 10/158,945, pending.
U.S. patent application Ser. No. 09/672,076, pending.

*Primary Examiner*—Yvonne M. Horton
(74) *Attorney, Agent, or Firm*—Stevens, Davis, Miller & Mosher, L.L.P.

(57) ABSTRACT

Flooring material comprising sheet-shaped floor elements (1) with a mainly square or rectangular shape. The floor elements (1) are provided with edges (2), a lower side (5) and an upper decorative layer (3). The floor elements (1) are intended to be joined by means of joining members (10). The floor elements (1) are provided with male joining members ($10^I$) on a first edge ($2^I$) while a second edge ($2^{II}$) of the floor elements (1) are provided with a female joining member ($10^{II}$). The male joining member ($10^I$) is provided with a tongue (11) and a lower side (5) groove (12) while the female joining member ($10^{II}$) is provided with a groove (13) and a cheek (14), the cheek (14) being provided with a lip (15). The floor elements (1) are provided with a male vertical assembly joining member ($10^{III}$) on a third edge ($2^{III}$) while a fourth, opposite, edge ($2^{IV}$) is provided with female vertical assembly joining member ($2^{IV}$). The floor elements (1) are alternatively provided with a male vertical assembly joining member ($10^{III}$) on a third edge ($2^{III}$) while a fourth, opposite, edge ($2^{IV}$) also is provided with male vertical assembly joining member ($2^{III}$). Adjacent male vertical assembly joining members ($2^{III}$) are hereby joined by means of a separate vertical assembly joining profile (30). Two adjacent edges (2) of a floor element (1) can hereby, at the same time, and in the same turning motion, be joined with a floor element (1) adjacent to the first edge ($2^I$) and a floor element adjacent to the third or fourth edge ($2^{III}$ and $2^{IV}$ respectively).

16 Claims, 3 Drawing Sheets

U.S. PATENT DOCUMENTS

| | | | | | |
|---|---|---|---|---|---|
| 3,798,111 | A | | 3/1974 | Lane et al. | |
| 3,807,113 | A | | 4/1974 | Turner | |
| 3,859,000 | A | | 1/1975 | Webster | |
| 3,921,312 | A | | 11/1975 | Fuller | |
| 4,426,820 | A | | 1/1984 | Terbrack et al. | |
| 4,449,346 | A | | 5/1984 | Tremblay | |
| 4,940,503 | A | | 7/1990 | Lindgren et al. | |
| 5,148,850 | A | | 9/1992 | Urbanick | |
| 5,216,861 | A | | 6/1993 | Meyerson | |
| 5,295,341 | A | | 3/1994 | Kajiwara | |
| 5,325,649 | A | | 7/1994 | Kajiwara | |
| 5,344,700 | A | | 9/1994 | McGath et al. | |
| 5,348,778 | A | | 9/1994 | Knipp et al. | |
| 5,502,939 | A | | 4/1996 | Zadok et al. | |
| 5,630,304 | A | | 5/1997 | Austin | |
| 5,706,621 | A | | 1/1998 | Pervan | |
| 5,797,237 | A | * | 8/1998 | Finkell, Jr. | 52/589.1 |
| 5,860,267 | A | * | 1/1999 | Pervan | 52/748.1 |
| 5,907,934 | A | | 6/1999 | Austin | |
| 6,006,486 | A | * | 12/1999 | Moriau et al. | 52/589.1 |
| 6,023,907 | A | | 2/2000 | Pervan | |
| 6,094,882 | A | * | 8/2000 | Pervan | 52/745.19 |
| 6,101,778 | A | | 8/2000 | Martensson | |
| 6,182,410 | B1 | | 2/2001 | Pervan | |
| 6,205,639 | B1 | | 3/2001 | Pervan | |
| 6,209,278 | B1 | * | 4/2001 | Tychsen | 52/592.4 |
| 6,216,409 | B1 | * | 4/2001 | Roy et al. | 52/589.1 |
| 6,314,701 | B1 | | 11/2001 | Meyerson | |
| 6,324,803 | B1 | | 12/2001 | Pervan | |
| 6,397,547 | B1 | | 6/2002 | Martensson | |
| 6,418,683 | B1 | | 7/2002 | Martensson et al. | |
| 6,421,970 | B1 | | 7/2002 | Martensson et al. | |

FOREIGN PATENT DOCUMENTS

| | | | |
|---|---|---|---|
| GB | 812671 | | 4/1959 |
| GB | 1348272 | | 3/1974 |
| GB | 1430423 | | 3/1976 |
| GB | 2256023 | | 11/1992 |
| JP | 3169967 | | 7/1991 |
| SE | 501014 | | 10/1994 |
| SE | 502994 | | 9/1996 |
| WO | 9313280 | | 7/1993 |
| WO | 9747834 | | 12/1997 |
| WO | WO 99/66151 | * | 12/1999 |

* cited by examiner

FLOORING MATERIAL

The present invention relates to a flooring material comprising sheet-shaped floor elements which are joined by means of joining members.

Prefabricated floor boards provided with tongue and groove at the edges are quite common nowadays. These can be installed by the average handy man as they are very easy to install. Such floors can, for example, be constituted of solid wood, fibre board or particle board. These are most often provided with a surface layer such as lacquer, or some kind of laminate. The boards are most often installed by being glued via tongue and groove. The most common types of tongue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilise in floors where no glue is to be used.

Such a joint is known through WO 94/26999 which deals with a system to join two floor boards. The floor boards are provided with a locking device at the rear sides. In one embodiment the floor boards are provided with profiles on the lower side at a first long side and short side. These profiles, which extends outside the floor board itself, is provided with an upwards directed lip which fits into grooves on the lower side of a corresponding floor board. These grooves are arranged on the second short side and long side of this floor board. The floor boards are furthermore provided with a traditional tongue and groove on the edges. The intentions are that the profiles shall bend downwards and then to snap back into the groove when assembled. The profiles are integrated with the floor boards through folding or alternatively, through gluing.

According to WO 94/26999, the floor boards may be joined by turning or prizing it into position with the long side edge as a pivot point. It is then necessary to slide the floor board longitudinally so that it snaps into the floor board previously installed in the same row. A play is essential in order to achieve that. This play seems to be marked Δ in the figures. A tolerance of ±0.2 mm is mentioned in the application. Such a play will naturally cause undesired gaps between the floor boards. Dirt and moisture can penetrate into these gaps.

It is also known through WO 97/47834 to manufacture a joint where the floor boards are joined by turning or prizing it into position with the long side edge as a pivot point. According to this invention a traditional tongue has been provided with heel on the lower side. The heel has a counterpart in a recess in the groove of the opposite side of the floor board. The lower cheek of the groove will be bent away during the assembly and will then snap back when the floor board is in the correct position. The snap-joining parts, i.e. the tongue and groove, is in opposite to the invention according to WO 94/26999 above, where they are constituted by separate parts, seems to be manufactured monolithically from the core of the floor board. WO 97/47834 does also show how the tongue and groove with heels and recesses according to the invention is tooled by means of cutting machining. This invention does also have the disadvantage that the the best mode of joining floor boards includes longitudinal sliding for joining the short sides of the floor boards, which also here will require a play which will cause unwanted gaps between the floor boards. Dirt and moisture can penetrate into these gaps.

It is, through the present invention, made possible to solve the above mentioned problems whereby a floor element which can be assembled without having to be slided along already assembled floor elements has been achieved. It is thereby made possible to achieve tighter joints. Accordingly, the invention relates to a flooring material comprising sheet-shaped floor elements with a mainly square or rectangular shape. The floor elements are provided with edges, a lower side and an upper decorative layer. The floor elements are intended to be joined by means of joining members. The invention is characterised in that;

a) The floor elements are provided with male joining members on a first edge while a second, opposite, edge of the floor elements are provided with a female joining member. The male joining member is provided with a tongue and a lower side groove. The female joining member is provided with a groove and a cheek, the cheek being provided with a lip. The floor elements are intended to mainly be joined together by tilting the floor element to be joined with an already installed floor element or a row of already installed floor elements, with the male joining member of the floor element angled downwards and that the first edge is allowed to be mainly parallel to the second edge of the already installed floor element or elements. The tongue of the tilted floor element is then inserted into the groove of the female joining member of the already installed floor element or elements. The tilted floor element is then turned downwards, with its lower edge as a pivot axis, so that the lip eventually snaps into the lower side groove where the decorative upper layer of the floor elements are mainly parallel.

b) The floor elements are moreover provided with a male vertical assembly joining member on a third edge while a fourth edge is provided with female vertical assembly joining member. The fourth edge is arranged on a side opposite to the third edge.

c) The floor elements are alternatively provided with a male vertical assembly joining member on a third edge, while a fourth edge also is provided with male vertical assembly joining member. The fourth edge is arranged on a side opposite to the third edge. Adjacent male vertical assembly joining members are thereby joined by means of a separate vertical assembly joining profile. Two adjacent edges of a floor element can hereby be joined with a floor element adjacent to the first edge and a floor element adjacent to the third or fourth edge at the same time, and in the same turning motion.

The force needed to overcome the static friction along the joint between two completely assembled male and female joining members is preferably larger than 10N per meter of joint length, suitably larger than 100N per meter of joint length.

According to one embodiment of the invention, the floor elements are provided with male vertical assembly joining members on a third edge and provided with female vertical assembly joining members on a fourth edge. The male vertical assembly joining members are provided with mainly vertical lower cheek surfaces arranged parallel to the closest edge. The lower cheek surfaces are intended to interact with mainly vertical upper cheek surfaces arranged on the female vertical assembly joining members so that two joined adjacent floor elements are locked against each other in a horizontal direction. The male and female vertical assembly joining members are provided with one or more snapping hooks with matching under cuts which by being provided with mainly horizontal locking surfaces limits the vertical movement between two joined adjacent floor elements.

The floor elements may alternatively be provided with male vertical assembly joining members on both a third and a fourth edge. These edges are then snap joined by means of a vertical assembly profile which on both sides of a longitudinal symmetry line is designed as a female vertical assembly joining member according to the description above. Two joined adjacent floor elements are locked to each other in a horizontal direction via the vertical assembly profile while, at the same time, vertical movement between two joined adjacent floor elements is limited.

The joint between a third and a fourth edge of two joined floor elements preferably comprises contact surfaces which are constituted by the horizontal locking surfaces of the under cuts and hooks, the mainly vertical upper cheek surfaces and lower cheek surfaces as well as upper mating surfaces.

The joint between two joined floor elements suitably also comprises cavities.

According to one embodiment of the invention the snapping hook is constituted by a separate spring part which is placed in a cavity. Alternatively the undercut is constituted by a separate spring part which is placed in a cavity. The spring part is suitably constituted by an extruded thermoplastic profile, a profile of thermosetting resin or an extruded metal profile.

The vertical assembly joining profiles are suitably shaped as extended profiles which suitably are manufactured through extrusion which is a well known and rational method. The vertical assembly joining profiles are suitably shaped as extended lengths or rolls which can be cut to the desired length. The length of the vertical assembly joining profiles considerably exceeds the length of a floor element, before being cut. The lateral joints of the floor will only need shorter pieces of vertical assembly joining profiles which are positioned as each new floor board is introduced to a row. Vertical assembly joining profiles according to the present invention may be manufactured of a number of different materials and manufacturing methods. Among the most suited can, however, be mentioned injection moulding and extrusion. Suitable materials are thermoplastic materials such as polyolefins, polystyrene, polyvinyl chloride or acrylnitrile-butadiene-styrene copolymer. These may suitably be filled with, for example, wood powder or lime in order to increase the rigidity but also to increase the adhesion when glue is used. It is also possible to mill a vertical assembly joining profile from a material such as wood, fibre board or particle board.

The flooring material including the floor boards and joining profiles above is most suited when installing floors where it isn't desired to use glue. It is, however, possible to use glue or twin-faced adhesive tape in order to make the installation irreversibly permanent. The glue or tape is then suitably applied on, or in connection to, possible cavities or faces below the upper mating surfaces.

The invention is described further in connection to enclosed figures showing different embodiments of a flooring material whereby, FIG. 1 shows, in cross-section, a first and a second edge $\mathbf{2}^{I}$ and $\mathbf{2}^{II}$ respectively, during joining.

Figure 1:
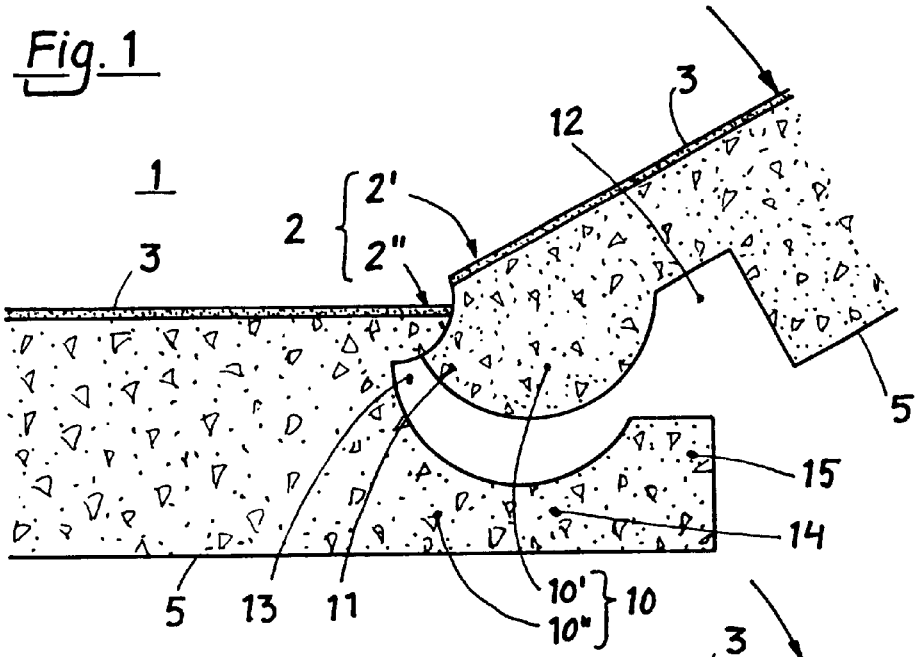

Accordingly FIG. 1 shows, in cross-section, a first and a second edge $\mathbf{2}^{I}$ and $\mathbf{2}^{II}$ respectively, during assembly. The figure shows parts of a flooring material comprising sheet-shaped floor elements 1 with a mainly square or rectangular shape. The floor elements 1 are provided with edges 2, a lower side 5 and an upper decorative layer 3. The floor elements 1 are intended to be joined by means of joining members 10. The floor elements 1 are provided with male joining members $\mathbf{10}^{I}$ on a first edge $\mathbf{2}^{I}$ while a second edge $\mathbf{2}^{II}$ of the floor elements 1 are provided with a female joining member $\mathbf{10}^{II}$. The second edge $\mathbf{2}^{II}$ is arranged on a side opposite to the first edge $\mathbf{2}^{I}$. The male joining member $\mathbf{10}^{I}$ is provided with a tongue 11 and a lower side 5 groove 12. The female joining member $\mathbf{10}^{II}$ is provided with a groove 13 and a cheek 14, the cheek 14 being provided with a lip 15. The floor elements 1 are intended to mainly be joined together by tilting the floor element 1 to be joined with an already installed floor element 1 or a row of already installed floor elements 1, with the male joining member $\mathbf{10}^{I}$ of the floor element 1 angled downwards and that the first edge $\mathbf{2}^{I}$ is allowed to be mainly parallel to the second edge $\mathbf{2}^{II}$ of the already installed floor element 1 or elements 1. The tongue 11 of the tilted floor element 1 is then inserted into the groove 13 of the female joining member $\mathbf{10}^{II}$ of the already installed floor element 1 or elements 1, whereby the tilted floor element 1 is turned downwards, with its lower edge as a pivot axis, so that the lip 15 eventually falls into the lower side 5 groove 12 where the decorative upper layer 3 of the floor elements 1 are mainly parallel.

Figure 2:
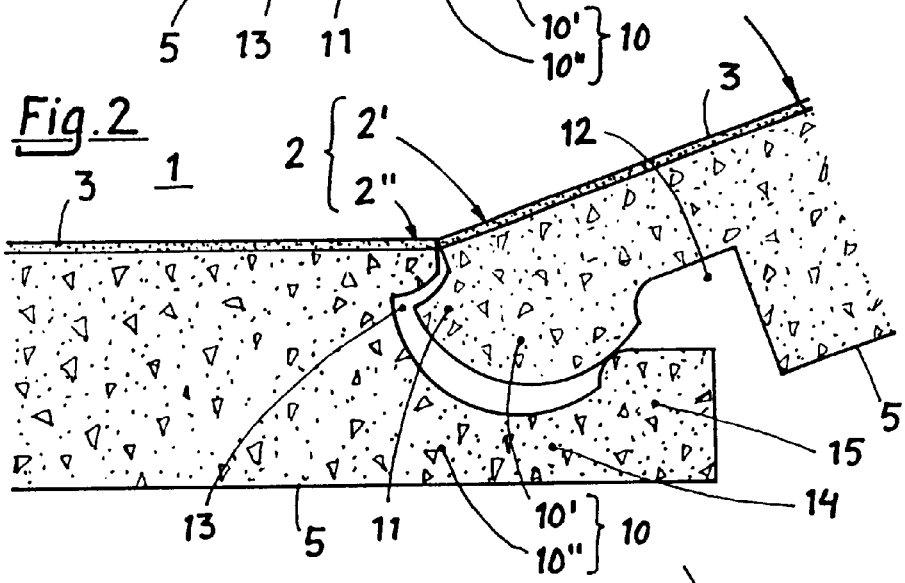
FIG. 2 shows, in cross-section, a second embodiment of a first and a second edge $\mathbf{2}^{I}$ and $\mathbf{2}^{II}$ respectively, during joining.

The embodiment shown in FIG. 2 corresponds mainly with the one shown in FIG. 1. The lip 15 and lower side 5 groove 12 are, however, provided with a cam 16 and a cam groove 17 which provides a snap action locking.

Figure 3:
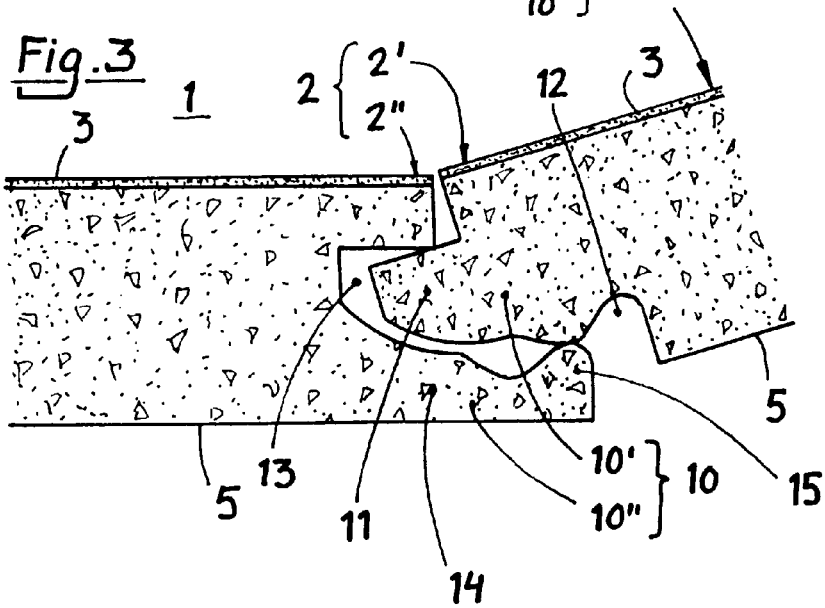
FIG. 3 shows, in cross-section, a third embodiment of a first and a second edge $\mathbf{2}^{I}$ and $\mathbf{2}^{II}$ respectively, during joining.

The embodiment shown in FIG. 3 corresponds mainly with the one shown in FIG. 1 and 2 above. The lip 15 and lower side 5 groove 12 are, however, provided with a cam 16 and a cam groove 17 which provides a snap action locking.

Figure 4:
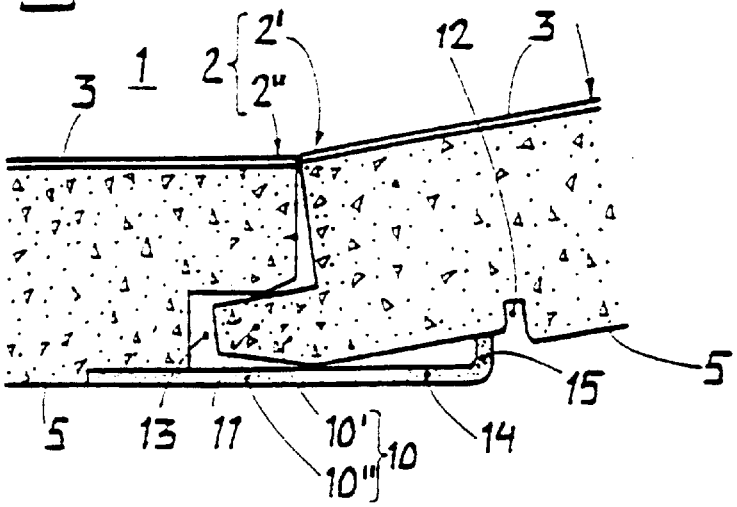
FIG. 4 shows, in cross-section, a fourth embodiment of a first and a second edge $\mathbf{2}^{I}$ and $\mathbf{2}^{II}$ respectively, during joining.

The embodiment shown in FIG. 4 corresponds mainly with the one shown in FIG. 1 above. The lip 15 and cheek 14 is however shaped as a thin resilient section which provides a snap action locking.

Figure 5:
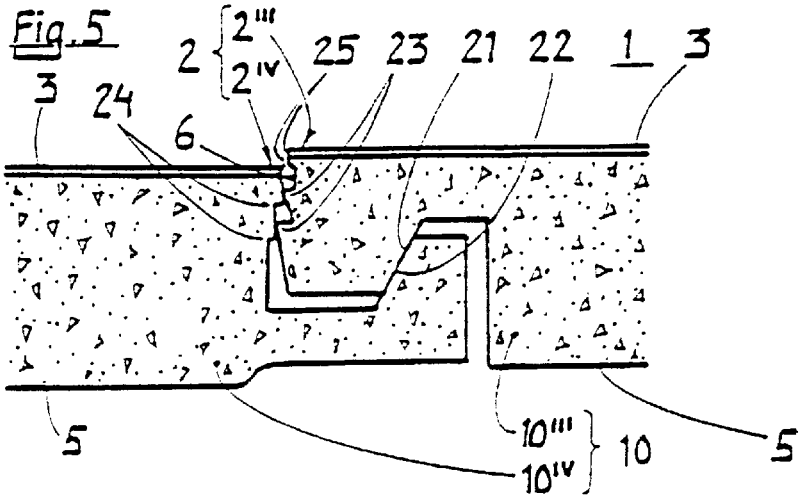
FIG. 5 shows, in cross-section, a third and a fourth edge $\mathbf{2}^{III}$ and $\mathbf{2}^{IV}$ respectively, during joining.

FIG. 5 shows, in cross-section, a third and a fourth edge $\mathbf{2}^{III}$ and $\mathbf{2}^{II}$ respectively, of a floor element 1 according to any of the FIGS. 1 to 4. The floor elements 1 are provided with a male vertical assembly joining member $10^{III}$ on a third edge $2^{III}$ while a fourth edge $2^{IV}$ is provided with a female vertical assembly joining member $10^{IV}$. The fourth edge $2^{IV}$ is placed on a side opposite to the third edge $2^{III}$. The male vertical assembly joining members $10^{III}$ are provided with mainly vertical lower cheek surfaces 21 arranged parallel to the closest edge 2. The lower cheek surfaces 21 are intended to interact with mainly vertical upper cheek surfaces 22 arranged on the female vertical assembly joining members $10^{IV}$ so that two joined adjacent floor elements 1 are locked against each other in a horizontal direction. The male vertical assembly joining members $10^{III}$ are moreover provided with two snapping hooks 23 while the female vertical assembly joining members $10^{IV}$ are provided with matching under cuts 24, which by being provided with mainly horizontal locking surfaces limits the vertical movement between two joined adjacent floor elements 1.

The joint between a third and a fourth edge $2^{III}$ and $2^{IV}$ respectively of two joined floor elements 1 further comprises contact surfaces which are constituted by the horizontal locking surfaces of the under cuts 23 and hooks 24, the mainly vertical upper cheek surfaces 22 lower cheek surfaces as well as upper mating surfaces 25. The joint between two joined floor elements 1 also comprises cavities 6.

Figure 6:
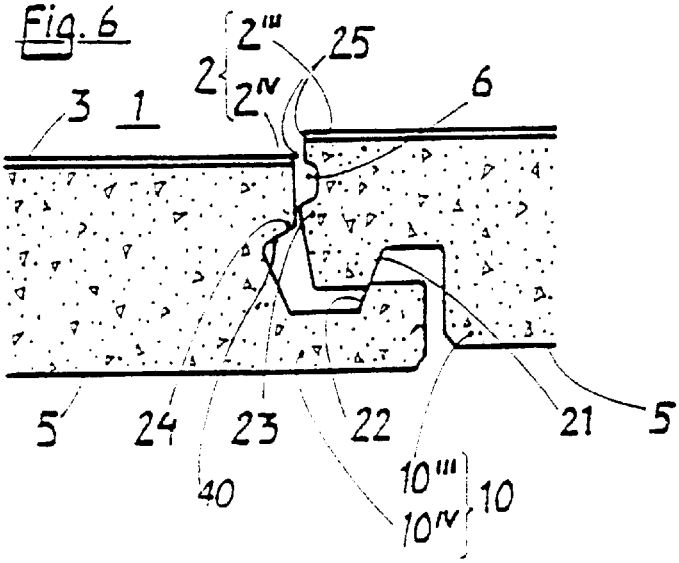
FIG. 6 shows, in cross-section, a second embodiment of a third and a fourth edge $\mathbf{2}^{III}$ and $\mathbf{2}^{IV}$ respectively, during joining.
Figure 7:
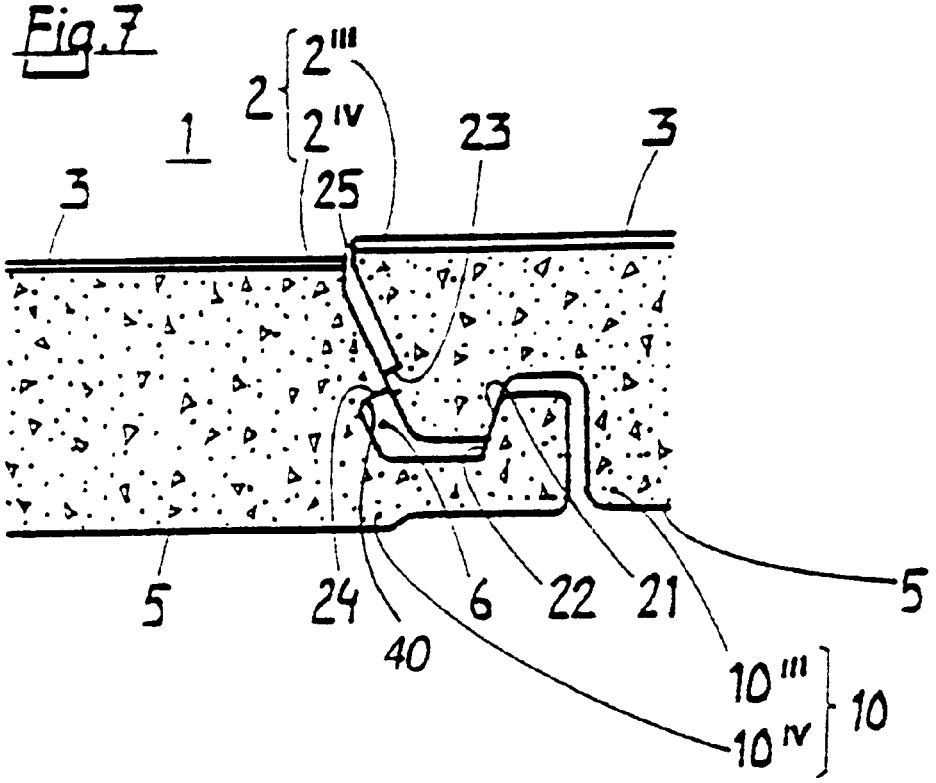
FIG. 7 shows, in cross-section, a third embodiment of a third and a fourth edge $\mathbf{2}^{III}$ and $\mathbf{2}^{IV}$ respectively, during joining.

Shown at 40, in both FIG. 6 and 7, are mainly horizontal locking surfaces of undercut 24. Specifically, mainly horizontal locking surfaces 40 are designed to interact with snapping hook 23 to lock the respective floor elements 1 in place.

The joint between a third and a fourth edge $2^{III}$ and $2^{IV}$ respectively of two joined floor elements 1 further comprises contact surfaces which are constituted by the horizontal locking surfaces of the under cuts 24 and hooks 23, the mainly vertical upper cheek surfaces 22 lower cheek surfaces as well as upper mating surfaces 25. The joint between two joined floor elements 1 also comprise cavities 6.

The embodiment shown in FIG. 7 corresponds in the main with the one shown in FIG. 6. The snapping hook 23 on the male vertical assembly joining member $10^{III}$ is, however, moved somewhat inwards in the floor element 1 whereby a guiding angle is formed above the undercut 24 of the female vertical joining member $10^{IV}$.

Figure 8:
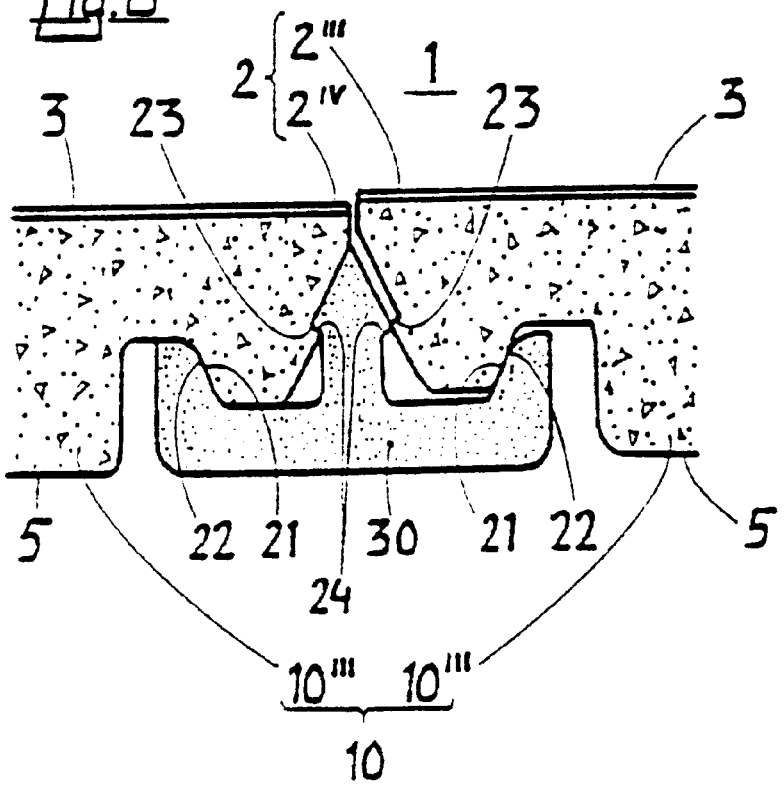
FIG. 8 shows, in cross-section, a fourth embodiment of a third and a fourth edge $\mathbf{2}^{III}$ and $\mathbf{2}^{IV}$ respectively and a vertical assembly joining profile 30, during joining.

The embodiment shown in FIG. 8 corresponds mainly with the one shown in FIG. 7. Both the third and the fourth edges $2^{III}$ and $2^{IV}$ respectively are, however, provided with male vertical assembly joining members $10^{III}$. A vertical assembly joining profile 30, provided with a female vertical assembly joining profile $10^{IV}$ on both sides of a vertical symmetry line, is used for joining the two floor elements 1. The female vertical assembly joining members $10^{IV}$ of the vertical assembly joining profile 30 are equipped similar to the female vertical assembly joining members $10^{IV}$ in FIG. 7 above.

Two adjacent edges 2 of a floor element 1 can at the same time, and in the same turning motion, be joined with a floor element 1 adjacent to the first edge $2^{I}$ and a floor element 1 adjacent to the third or fourth edge $2^{III}$ and $2^{IV}$ respectively, when assembling floor elements 1 according to the above described embodiments.

The floor elements 1 according to the present invention most often comprises a core. The core is most often comprised of particles or fibre of wood bonded with resin or glue. It is advantageous to coat the surface closest to the joint in cases where the floor will be exposed to high levels of moisture since the cellulose based material is sensitive to moisture. This coating may suitably incorporate resin, wax or some kind of lacquer. It is not necessary to coat the joint when it is to be glued since the glue itself will protect from moisture penetration. The upper decorative layer 3 is constituted of a decorative paper impregnated with melamine-formaldehyde resin. One or more so called overlay sheets of α-celluloce, impregnated with melamine-formaldehyde resin may possibly be placed on top of the decorative layer. The abrasion resistance may be improved by sprinkling one or more of the sheets with hard particles of for example α-aluminium oxide, silicon carbide or silicon oxide. The lower side 5 may suitably be coated with lacquer or a layer of paper and resin.

The invention is not limited by the embodiments shown since they can be varied within the scope if the invention.

What is claimed is:

1. Flooring material comprising sheet-shaped floor elements with a mainly square or rectangular shape, which floor elements are provided with edges, a lower side and an upper decorative layer, whereby the floor elements are joined by means of joining members, the edges being separated into a first and a second edge, which first and second edges are arranged on opposite sides, and a third and a fourth edge being adjacent to the first and the second edge and which third and fourth edges are arranged on sides opposite to one another, whereby the floor elements are provided with male joining members on the first edge, having a tongue and a lower side groove, and female joining members on the second edge, having a groove and a cheek, the cheek being provided with a lip, whereby the floor elements are joined together via the male and female joining members by tilting the floor element to be joined with an already installed floor element or a row of already installed floor elements, with the male joining member of the floor element angled downwards, that the first edge is positioned mainly parallel to the second edge of the already installed floor element or row of floor elements, whereupon the tongue of the titled floor element is inserted into the groove of the female joining member of the already installed floor element or row of floor elements, whereby the tilted floor element is turned downwards, with its lower edge as a pivot axis, so that the lip eventually snaps into the lower side groove where the decorative upper layer of the floor elements are mainly parallel, and that the third and fourth edges of the floor elements are joined by means of joining members selected from the group consisting of:

a) wherein the floor elements, on the third edge, are provided with a male vertical assembly joining member while the fourth edge is provided with a female vertical assembly joining member, the fourth edge being arranged on a side opposite to the third edge, the male vertical assembly joining members being provided with mainly vertical lower cheek surfaces arranged parallel to the third edge, which lower cheek surfaces are arranged to interact with undercuts arranged on the female vertical assembly joining members so that two joined adjacent floor elements becomes locked to each other in a horizontal direction, that together the male and female vertical assembly joining members are provided with at least one snapping hook to interact with said undercuts which by being provided with a mainly horizontal locking surface limits the vertical movement between two joined adjacent floor elements, whereby the third edge and the fourth edge are joined with respective edges of adjacent floor elements through vertical motion, and b) wherein the floor elements on the third edge, are provided with a male vertical assembly joining member while the fourth edge also is provided with a male vertical assembly joining member, the fourth edge being arranged on a side opposite to the third edge, which adjacent male vertical assembly joining members are joined by means of a separate vertical assembly joining profile which vertical assembly profile is provided with female vertical assembly joining member, the male vertical assembly joining members being provided with mainly vertical lower cheek surfaces arranged parallel to either the third or the fourth the edge, which lower cheek surfaces are arranged to interact with mainly vertical upper cheek surfaces arranged on the female vertical assembly joining members so that two joined adjacent floor elements becomes locked to each other in a horizontal direction, that together the male and female vertical assembly joining members are provided with at least one snapping hook to interact with said undercut which by being provided with a mainly horizontal locking surface limits the vertical movement between two joined adjacent floor elements, whereby the third edge and the fourth edge are joined with respective edges of adjacent floor elements through vertical motion, whereby two adjacent edges of a floor element at the same time, and concurrently with the turning motion, is joined with a floor element adjacent to the first edge and a floor element adjacent to the third or fourth edge.

2. Flooring material according to claim 1, wherein the force needed to overcome the static friction along the joint between two completely assembled male and female joining members is larger than 10N per meter of joint length.

3. Flooring material according to claim 1, wherein the floor elements are provided with male vertical assembly joining members on a third edge and provided with female vertical assembly joining members on a fourth edge, the male vertical assembly joining members being provided with mainly vertical lower cheek surfaces arranged parallel to the third edge, which lower cheek surfaces are arranged to interact with mainly vertical upper cheek surfaces arranged on the female vertical assembly joining members so that two joined adjacent floor elements becomes locked to each other in a horizontal direction, that together the male and female vertical assembly joining members are provided with at least one snapping hook with matching undercut which by being provided with a mainly horizontal locking surface limits the vertical movement between two joined adjacent floor elements.

4. Flooring material according to claim 3, wherein the joint between third and the fourth edge of two joined floor elements comprises contact surfaces which are constituted by the mainly horizontal locking surfaces of the undercuts and hooks, the mainly vertical upper cheek surfaces and lower cheek surfaces as well as upper mating surfaces.

5. Flooring material according to claim 4, wherein the joint between two joined floor elements also comprises cavities.

6. Flooring material according to any of the claims 3–5, wherein the snapping hook is constituted by a separate spring part placed in a cavity.

7. Flooring material according to claim 6, wherein the spring part is constituted by an extruded thermoplastic profile.

8. Flooring material according to claim 6, wherein spring part is constituted by a profile of a thermosetting resin.

9. Flooring material according to claim 6, wherein spring part is constituted by an extruded metal profile.

10. Flooring material according to any of the claims 3–5, wherein the undercut is constituted by a separate spring part which is placed in a cavity.

11. Flooring material according to claim 10, wherein the spring part is constituted by an extruded thermoplastic profile.

12. Flooring material according to claim 10, wherein spring part is constituted by a profile of a thermosetting resin.

13. Flooring material according to claim 10, wherein spring part is constituted by an extruded metal profile.

14. Flooring material according to claim 1, wherein the floor elements are coated with twin-faced adhesive tape or glue.

15. Flooring material according to claim 1, wherein the joining members are coated with twin-faced adhesive tape or glue.

16. Flooring material according to claim 1, wherein the force needed to overcome the static friction along the joint between two completely assembled male and female joining members is larger than 100N per meter of joint length.

* * * * *